US005099173A

United States Patent [19]

Kim et al.

[11] Patent Number: 5,099,173

[45] Date of Patent: Mar. 24, 1992

[54] PLASMA DISPLAY PANEL HAVING AN AUXILIARY ANODE ON THE BACK SUBSTRATE

[75] Inventors: Jung-hoe Kim; Seong-heon Kim, both of Seoul, Rep. of Korea

[73] Assignee: Samsung Electron Devices Co., Ltd., Rep: of Korea

[21] Appl. No.: 611,704

[22] Filed: Nov. 13, 1990

[30] Foreign Application Priority Data

Jan. 31, 1990 [KR] Rep. of Korea ..... 90-1215
Jan. 31, 1990 [KR] Rep. of Korea ..... 90-1217

[51] Int. Cl.[5] ..... H01J 17/34

[52] U.S. Cl. ..... 313/585; 313/584; 313/586

[58] Field of Search ..... 313/485, 492, 581, 582, 313/584, 585, 493, 586; 340/773, 775

[56] References Cited

U.S. PATENT DOCUMENTS 4,625,148 11/1986 Geffcken ..... 313/585
4,996,460 2/1991 Kim et al. ..... 313/586
4,999,541 3/1991 Kim et al. ..... 313/585

*Primary Examiner*—Donald J. Yusko
*Assistant Examiner*—N. D. Patel
*Attorney, Agent, or Firm*—Cushman, Darby & Cushman

[57] ABSTRACT

A planar discharge type PDP in which all of the electrodes are formed on one substrate. Auxiliary and display anodes, first and second dielectric layers and display cathodes are formed in intersecting strips in substantially parallel planes. The second dielectric layer is provided with a light shielding plate to achieve a PDP in which auxiliary and display discharge both occur in a single cell, has increased luminance and efficiency of light transmission, and yields an increased lifetime for the phosphor layer of a color PDP.

5 Claims, 6 Drawing Sheets

PLASMA DISPLAY PANEL HAVING AN AUXILIARY ANODE ON THE BACK SUBSTRATE

BACKGROUND OF THE INVENTION

1. Field of the Invention

The present invention relates to a plasma display panel (PDP) and a manufacturing method thereof; more particularly, to a planar discharge type PDP with improved luminance, and a manufacturing method thereof.

2. Description of the prior art

Recently, design efforts related to plasma display panels (PDPs) have increased because of the PDP's advantages over other types of display devices. For example, the PDP can be made to be of a large size, has more than twice the lifetime of conventional cathode ray tubes (CRTs), and can be easily produced in large quantities due to its simple structure.

One type of PDP is disclosed in the Applicant's co-pending Korean patent application No. 90-1215. Referring to FIG. 1, this type of PDP comprises a back glass substrate 100 and a front glass substrate 200. Display cathodes 130, dielectric layer 120 and display anodes 150 are sequentially formed in strips on the back glass substrate 100 by a conventional screen printing technique. The display cathodes 130 and display anodes 150 are of different orientations, and would intersect each other but for their separation by the dielectric layer 120. A lattice type barrier rib 160 is formed on the back glass substrate 100 and has an electric charge particle path 170.

Auxiliary anodes 110 are formed in strips on the front glass substrate 200. The auxiliary anodes 110 and the display cathodes 130 are of different orientations, and would intersect but for their separation by the barrier rib 160. The electric charge particle path 170 corresponds with the auxiliary anodes 110.

This PDP improves the display discharge by using an auxiliary discharge between the auxiliary anode and the display cathode in addition to the display discharge between the display anode and the display cathode. Both display discharge and auxiliary discharge occur within a single cell.

However, in this type of PDP, the luminance and efficiency of light transmission is reduced because the auxiliary anodes are formed on the front glass substrate.

In the case of a color PDP, a phosphor layer is provided on the inner surface of the front glass substrate. The placement of auxiliary anodes on the front substrate results in an auxiliary discharge which occurs near the inner surface on the front glass substrate, thus reducing the lifetime of the phosphor layer.

SUMMARY OF THE INVENTION

Accordingly, it is an object of the present invention to provide a planar discharge type PDP of improved luminance.

It is a further object of the present invention to provide a planar discharge type PDP with improved efficiency of light transmission.

It is still a further object of the present invention to provide a planar discharge type color PDP in which the lifetime of the phosphor layer is increased.

These and other objects of the present invention are achieved by a PDP in which all of the electrodes are formed on the back substrate. The PDP comprises a back substrate, a front substrate, auxiliary anodes formed in strips on the back substrate, and a first dielectric layer formed on the back substrate. The first dielectric layer covers the auxiliary anodes, but leaves portions of the auxiliary anodes exposed. Display cathodes are formed in strips on the first dielectric layer.

The PDP further comprises a second dielectric layer formed in strips on the display cathode strips. The second dielectric layer strips intersect the display cathode strips, and display anodes are formed in strips on the second dielectric layer strips.

The PDP further comprises a lattice type barrier rib formed on the back substrate which is provided with an electric charge particle path corresponding to the exposed portions of the auxiliary anodes.

The PDP further comprises a front substrate which is sealingly attached to the barrier rib and back glass substrate such that a plurality of discharge cells are formed, each discharge cell containing portions of each of a display anode, a display cathode, and an auxiliary anode.

According to another embodiment of the present invention, the first dielectric layer may be formed in strips which intersect and cover portions of the auxiliary anode strips, and the second dielectric layer may be provided with a light-shielding plate for shielding the non-covered portions of the auxiliary anodes.

The PDP of the present invention is produced by a method comprising the steps of:

forming auxiliary anodes in strips on a back substrate;

forming a first dielectric layer of a substantially uniform thickness which covers first portions of the auxiliary anodes and leaves second portions of the auxiliary anodes exposed;

forming display cathodes on the first dielectric layer;

forming a second dielectric layer of substantially uniform thickness in strips on the display cathodes;

forming display anodes in strips on said second dielectric layer strips;

forming a barrier rib on the back substrate, the barrier rib being provided with an electric charge particle path corresponding to the second portions of the auxiliary anodes and sealingly attaching a front substrate to the barrier rib and the back substrate such that a plurality of discharge cells are formed, each of the discharge cells containing portions of each of a display anode, a display cathode, and an auxiliary anode.

According to another method of the present invention, the first dielectric layer is formed in strips which intersect the auxiliary anodes and cover the auxiliary anodes at the points of intersection. A light shielding plate is formed simultaneously with the second dielectric layer, and shields portions of the auxiliary anodes not covered by the first dielectric layer strips.

BRIEF DESCRIPTION OF THE DRAWINGS

A more complete understanding of the present invention and its advantages will result from studying the following detailed description of specific embodiments together with the accompanying drawings in which.

DETAILED DESCRIPTION OF SPECIFIC EMBODIMENTS

Figure 1:
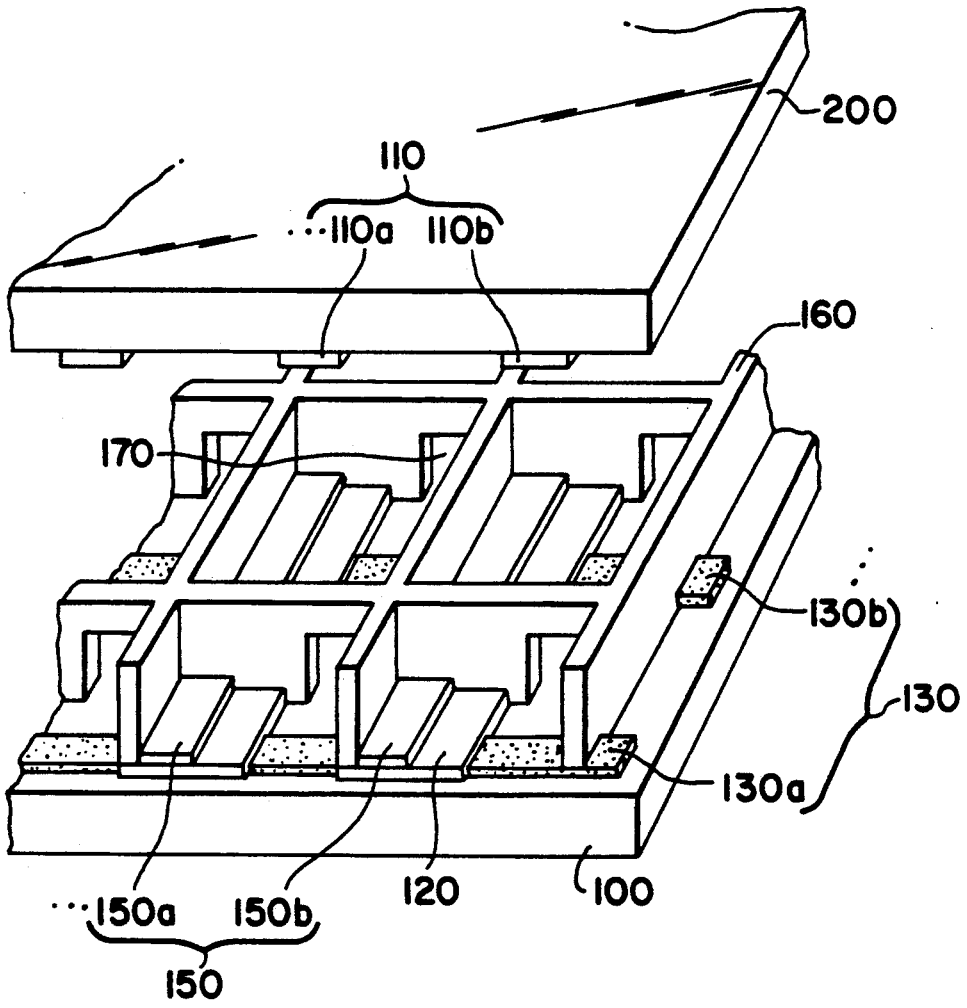
FIG. 1 (PRIOR ART)
FIG. 1 is a partially broken, perspective view of a conventional planar discharge type PDP.

The PDP according to a first embodiment of the present invention will now be described with reference to FIG. 2 and FIG. 3. Auxiliary anodes 11 are formed in strips 11*a*, 11*b*, . . . on a back substrate 10, which may be made of glass. The auxiliary anodes 11 are coated with a first dielectric layer 12. Portions of each of the auxiliary anodes 11 are left exposed so as to provide for an auxiliary discharge.

Display cathodes 13 are formed in strips 13*a*, 13*b*, . . . on the first dielectric layer 12. The display cathodes 13 are of a different orientation than the auxiliary anodes 11, and would intersect the auxiliary anodes 11 but for their separation by the first dielectric layer 12. The first dielectric layer 12 is of substantially uniform thickness and thus provides for a substantially uniform separation distance between the planes of the display cathodes 13 and the auxiliary anodes 11.

A second dielectric layer 14 is formed on the first dielectric layer 12 in strips of a substantially uniform thickness which intersect with the display cathodes 13 and cover the display cathodes 13 at the points of intersection.

Display anodes 15 are formed on said second dielectric layer strips in strips 15*a*, 15*b*, . . . Display anodes 15 are of substantially the same orientation as the second dielectric layer strips 14, and would thus intersect with display cathodes 13 but for their separation by the second dielectric layer 14.

Lattice type barrier rib 16 is formed on the back substrate 10, and is provided with an electric charge particle path 17. The electric charge particle path 17 corresponds with the exposed portions of the auxiliary anodes 11. The back glass substrate 10 and barrier rib 16 are sealingly attached to a front substrate 20, which may also be made of glass. The interior of the PDP is maintained in a vacuum and its circumference is sealed after introducing a discharge gas into the interior of the panel.

Accordingly, a PDP is formed in which individual cells of the lattice type barrier rib 16 include portions of each type of electrode, for example, display cathode 13*a*, auxiliary anode 11*a*, and display anode 15*a*. Thus, a display discharge and an auxiliary discharge can occur within a single cell.

The electrodes, dielectric layers, and barrier rib of the PDP may be formed using a conventional screen printing technique, though other techniques may be used as will be appreciated by those of skill in the art.

If a color PDP is desired, a phosphor layer may be coated on the inner surface of the front substrate 20 in the lattice of lattice type barrier rib 16.

Figure 4:
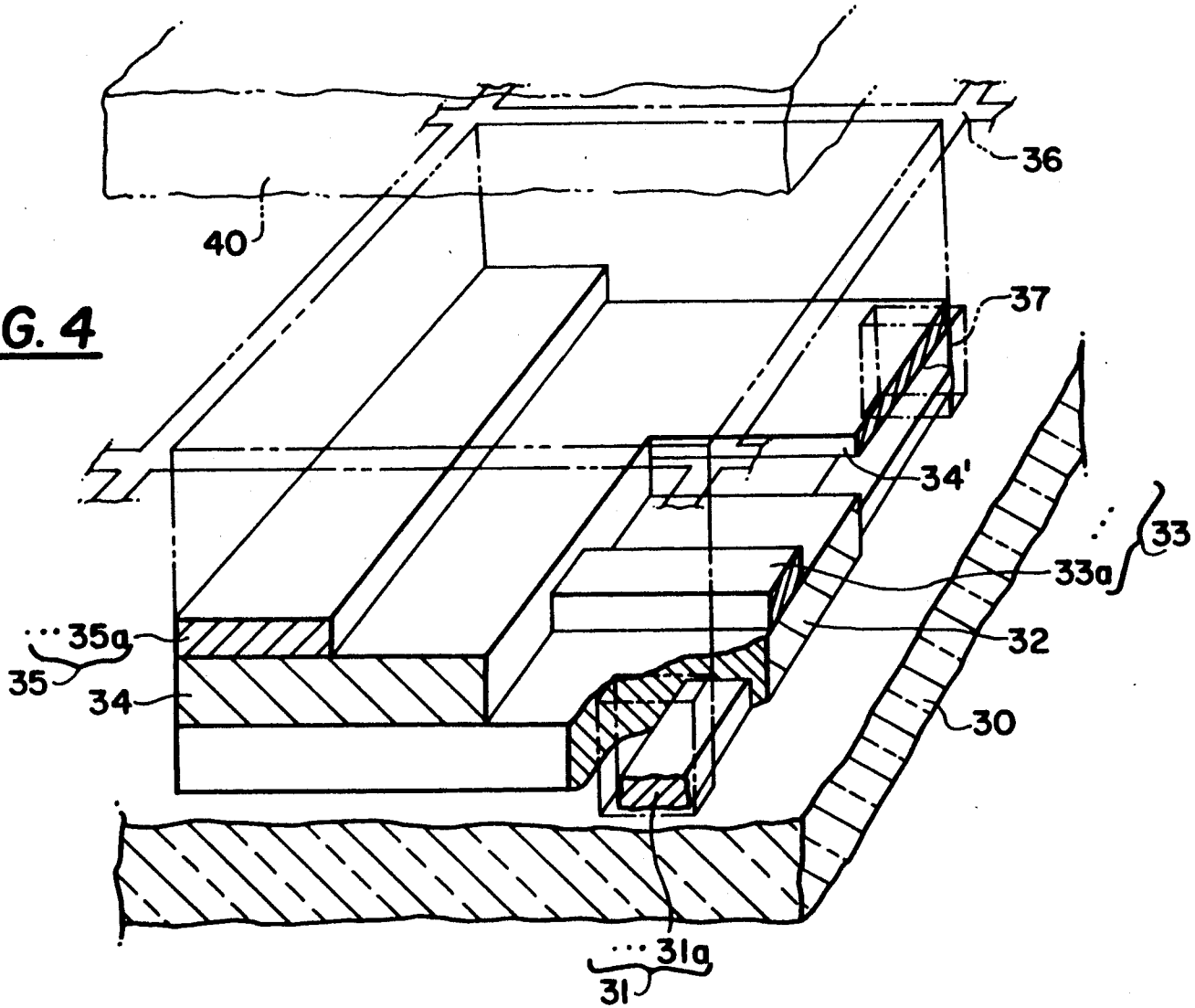
FIG. 4 is a partially broken, perspective view of a planar discharge type PDP of another embodiment of the present invention.
Figure 5:
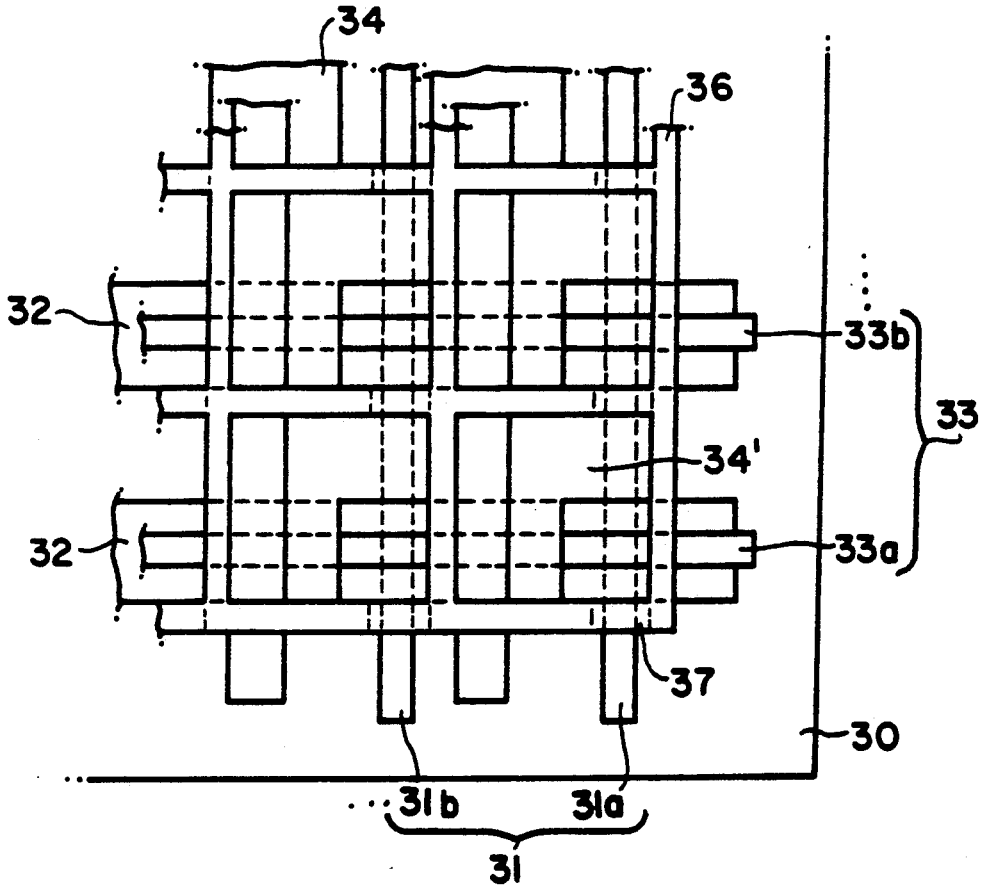
FIG. 5 is a plan view of a planar discharge type PDP of another embodiment of the present invention.

Referring now to FIG. 4 and FIG. 5, a PDP according to another embodiment of the present invention is shown. Auxiliary anodes 31 are formed in strips 31*a*, 31*b*, . . . on back substrate 30. The back substrate 30 may be made of glass, and the auxiliary anodes 31 may be formed of a transparent material.

A first dielectric layer 32 is formed on the back substrate 30 in strips which intersect the auxiliary anodes 31. The first dielectric layer strips 32 cover the auxiliary anodes 31 at the points of intersection. Display cathodes 33 are formed in strips 33*a*, 33*b*, . . . on the first dielectric layer strips 32.

A second dielectric layer 34 is formed over the display cathode strips 33 in strips of a substantially uniform thickness which intersect with the display cathode strips 33 and cover the display cathode strips 33 at the points of intersection. Display anodes 35 are formed in strips 35*a*, 35*b*, . . . on the second dielectric layer strips 34. The strips 35*a*, 35*b*, . . . thus lie in a plane substantially parallel to the planes of the auxiliary anode strips 31*a*, 31*b*, . . . and the display cathode strips 33*a*, 33*b*, . . . The display anodes 35 are of substantially the same orientation as the second dielectric layer strips 34; thus, the display anode strips 35*a*, 35*b*, . . . would intersect with the display cathode strips 33*a*, 33*b*, . . . but for their separation by the second dielectric layer 34. Thus, portions of display cathodes 33 are left exposed.

Further, the second dielectric layer includes light shielding plates 34' which cover an area over portions of the auxiliary anodes 31 not covered by the intersecting strips of first dielectric layer 32.

Auxiliary discharge occurs between the auxiliary anodes 31 and the display cathodes 33 in the areas covered by the portions 34'. Similarly, display discharge occurs between the display cathodes 33 and the display anodes 35 in the areas left exposed by the second dielectric layer 34.

A lattice type barrier rib 36 is formed on the back substrate 30 and is provided with an electric charge particle path 37 which corresponds with the auxiliary anodes.

Thus, a PDP is produced wherein individual cells of lattice type barrier rib 3 include portions of each type of electrode, and in which discharge will occur, for example, by an auxiliary discharge between display cathode 33*a* and the auxiliary anode 31*a* and a display discharge between display cathode 33*a* and display anode 35*a*.

If a color PDP is desired, a phosphor layer may be provided as a coating o the inner surface of the front glass substrate 40 positioned within the lattice of lattice type barrier rib 36.

After the back glass substrate 30 and the front glass substrate 40 are formed as described above, the interior of the PDP is maintained in a vacuum and the circumference is sealed after the introduction of a discharge gas into the interior of the panel.

Figure 2:
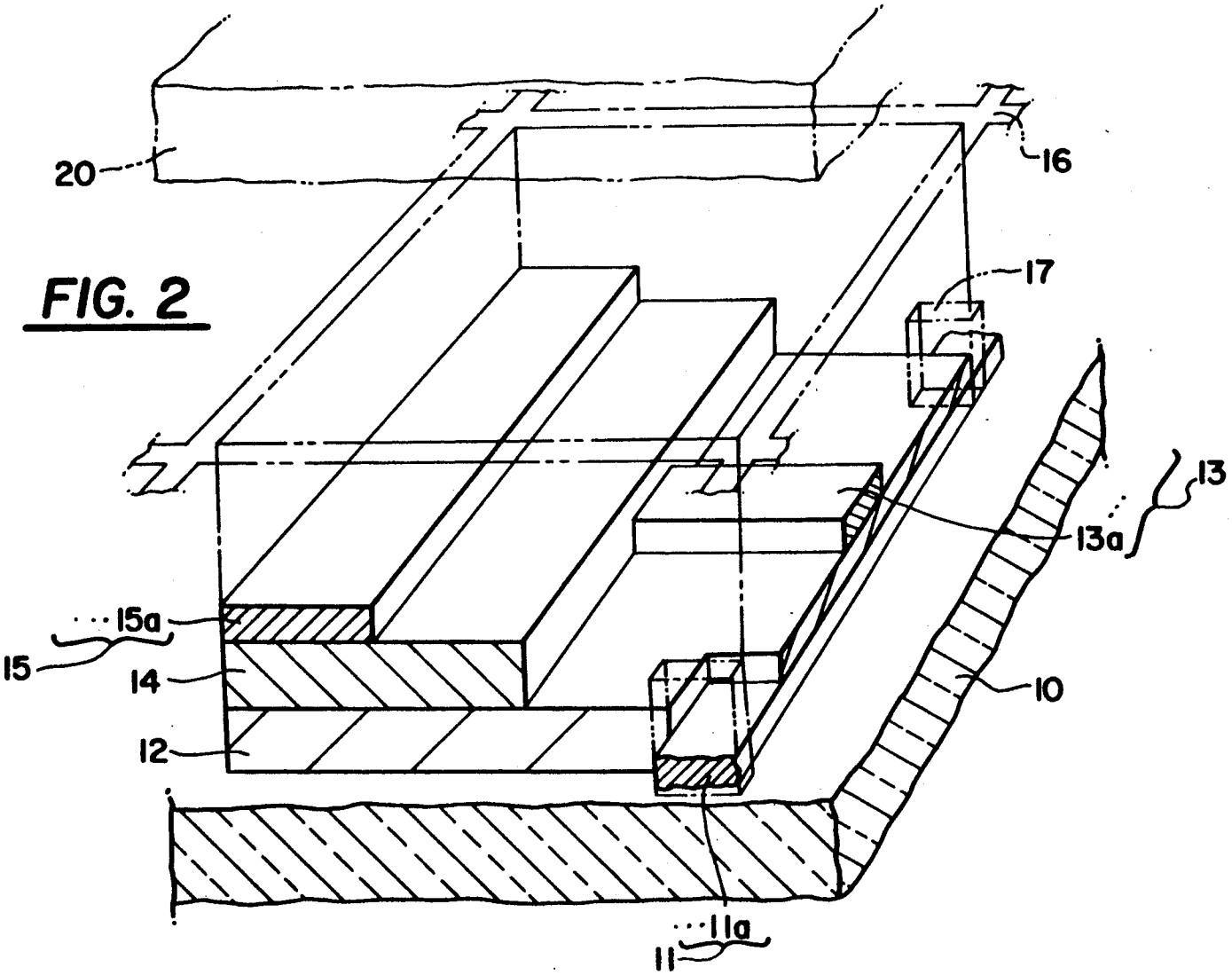
FIG. 2 is a partially broken, perspective view of a planar discharge type PDP of one embodiment of the present invention.
Figure 3:
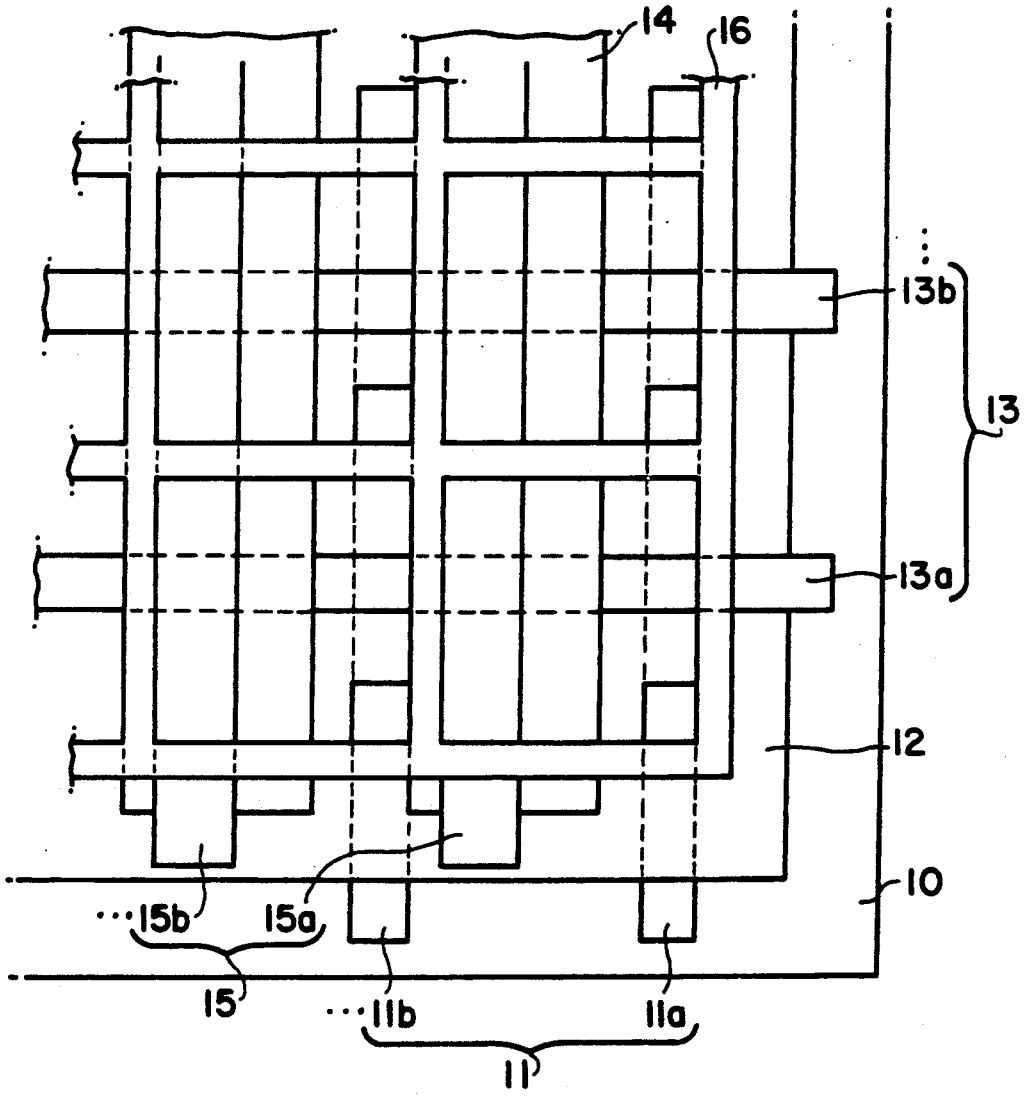
FIG. 3 a plan view of a planar discharge type PDP of one embodiment of the present invention.

The electrodes, dielectric layers, and barrier rib may all be formed using a conventional screen printing technique, as in the PDP of FIGS. 2 and 3. More specifically, the formation of the second dielectric layer 34 and the light-shielding plate 34' will be described with reference to FIGS. 6A–6E.

Figure 6A:
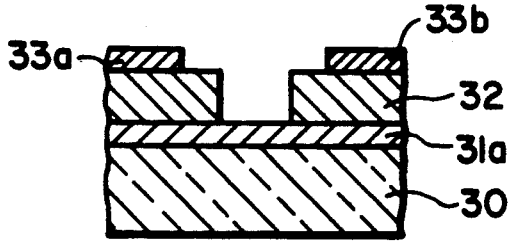
FIGS. 6A–6E show the manufacturing process of a light-shielding plate according to the present invention.
Figure 6B:
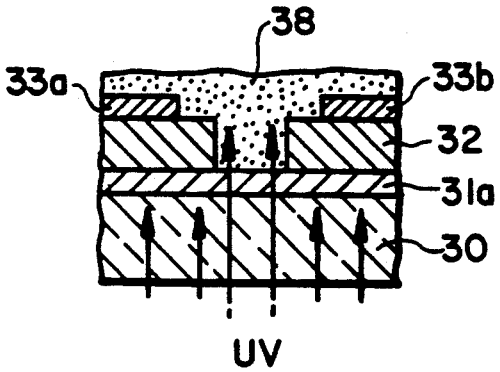

FIG. 6A shows a portion of the back glass substrate 30 with auxiliary anode strip 31*a*, the strips of dielectric layer 32, and display cathode strips 33*a* and 33*b* formed thereon. This assembly is coated with an aqueous solution 38, as shown in FIG. 6B. The aqueous solution 38 may be a solution of high viscosity, for example, an aqueous polyvinyl alcohol solution with diazonium salt. The aqueous solution 38 coats the entire surface of the device in the state wherein auxiliary anode 31, first dielectric layer 32, and display cathodes 33 are printed onto the back glass substrate 30.

Figure 6C:
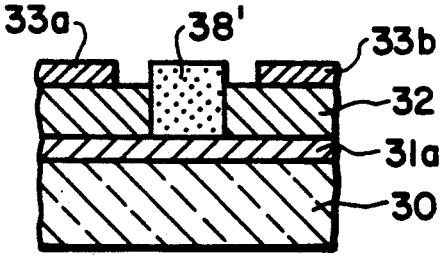

A supporting layer 38' is formed as shown in FIG. 6C. After a coating of the aqueous solution 38 has been applied and begins drying, the back glass substrate 30 is exposed to ultraviolet light UV, and the supporting layer 38' develops through curing of the aqueous solution 38. The amount of ultraviolet light used to cure the aqueous solution 38 is controlled so that the height of the supporting layer 38' is equivalent to that of the display cathode strips 33*a*, 33*b*.

Figure 6D:
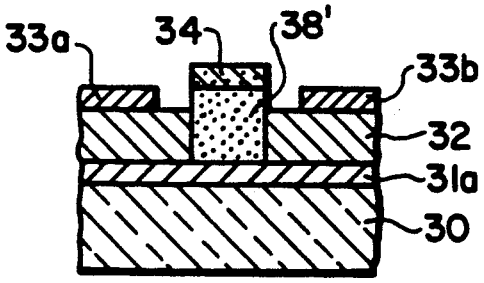

FIG. 6D shows the formation of the second dielectric layer 34, which is printed and formed on the hardened supporting layer 38'. Referring back to FIG. 5, the second dielectric layer 34 is printed and formed simultaneously with the display cathodes 33 on the hardened support layer 38'.

Figure 6E:
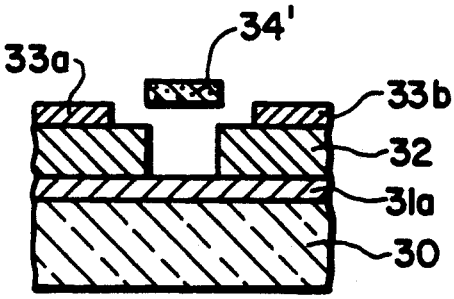

FIG. 6E shows the formation of the light shielding plate 34'. If the assembly of FIG. 6D is heated at 600° C., the supporting layer 38' will decompose, thus leaving a portion 34' of the second dielectric layer 34 left in a floating state. This portion 34' of the second dielectric layer 34 divides the discharge space into an upper side and a lower side, so that it serves as a light-shielding plate which prevents leaking out of the light produced in the lower side, where the auxiliary discharge occurs. The space formerly occupied by the supporting layer 38' is utilized as the auxiliary discharge area and the electric charge particle path 37.

The operation of the present invention will now be described based on the driving type of PDP disclosed in Japanese patent No. sho 57-86886. A voltage pulse is supplied between the display cathode 33*a* and the auxiliary anode 31*a*, and an auxiliary discharge is generated in a particular pixel, wherein electric charge particles are produced. These particles sequentially move into an adjacent auxiliary discharge area through the electric charge particle path 37. Then, when data is written (that is, a voltage is applied) on display anode 35*a*, display discharge is quickly generated due to the effect of pre-charging. Thus, the time required for discharge is reduced and the voltage pulse rate can be increased, resulting in increased luminance.

Further, the planar discharge between the display anode and the display cathode, in the case of a color PDP, results in increased lifetime for the phosphor layer because the inner surface of the glass substrate is protected from any harmful effects of the auxiliary discharge.

Further, the manufacturing process is simplified by forming all of the electrodes on one substrate, and costs are accordingly reduced.

In addition, because no electrode is formed on the front glass substrate, the effective visibility area is increased, thus increasing the efficiency of light transmission.

Still further, the shielding of the light generated by the auxiliary discharge between the display cathode and the auxiliary anode prevents light from leaking out. The generation of each successive electric charge particle combines with the generation of previous electric charge particles to increase the luminance. Since the auxiliary discharge area and display discharge area are separated by the light-shielding plate, erroneous discharge can be reduced.

While the invention has been described in connection with certain specific embodiments, the foregoing description should not be construed as limiting the scope of the invention, but rather as merely providing an illustration thereof. Numerous modifications will be readily apparent to one skilled in the art. Accordingly, it is the Applicants' intention to define the scope of the invention by the appended claims and their legal equivalents.

What is claimed is:

1. A plasma display panel, comprising:

a back substrate;

auxiliary anodes formed in strips of a first orientation on said back substrate;

a first dielectric layer formed on said back substrate, said first dielectric layer substantially covering first portions of said auxiliary anodes and leaving second portions of said auxiliary anodes exposed;

display cathodes formed on said first dielectric layer in strips of a second orientation with said first dielectric layer being disposed between said auxiliary anodes and said display cathodes at the points of intersection thereof;

a second dielectric layer formed on said first dielectric layer in strips of a third orientation;

display anodes formed on said second dielectric layer strips in strips of said third orientation with said second dielectric layer being disposed between said display cathodes and said display anodes at the points of intersection thereof;

a lattice type barrier rib formed on said back substrate and defining a plurality of discharge cells; said barrier rib having openings therein defining an electric charge particle path extending from cell-to-cell within said rib, each said auxiliary anode second portion extending into one of said openings so that the electric charge particle path defined by said opening also is partially defined by and passes directly over said auxiliary anode second portion to thereby facilitate the movement from cell-to-cell within said rib of electric charge particles attracted to said auxiliary anode; and a front substrate sealingly attached to said barrier rib and said back substrate to complete the formation of said discharge cells, each of said discharge cells containing portions of each of a display anode, a display cathode, and an auxiliary anode.

2. The plasma display panel of claim 1, wherein said back substrate and said front substrate are made of glass.

3. The plasma display panel of claim 1, wherein said first dielectric layer and said second dielectric layer strips are of a substantially uniform thickness.

4. The plasma display panel of claim 1, wherein said second dielectric layer includes a light shielding plate which covers the area over said second portion of said auxiliary anodes.

5. The plasma display panel of claim 1, wherein said auxiliary anodes are made of transparent material.

* * * * *